United States Patent [19]

Amit

[11] Patent Number: 4,514,617

[45] Date of Patent: Apr. 30, 1985

[54] TWO-STAGE ELECTRIC WATER HEATER

[76] Inventor: Haim Amit, House No. 213/1, Yokneam, Israel

[21] Appl. No.: 459,109

[22] Filed: Jan. 19, 1983

[51] Int. Cl.[3] ..... H05B 1/02; H05B 3/82; F24H 1/20

[52] U.S. Cl. ..... 219/314; 122/13 A; 126/351; 126/362; 219/306; 219/316; 219/331

[58] Field of Search ..... 219/310, 312, 314, 316, 219/318, 306, 307, 296–299, 328, 331; 126/362, 361, 351; 122/13 A

[56] References Cited

U.S. PATENT DOCUMENTS

| | | | |
|---|---|---|---|
| 2,742,560 | 4/1956 | Liebhafsky | 126/362 X |
| 4,403,137 | 9/1983 | Glazer | 219/306 |

FOREIGN PATENT DOCUMENTS

| | | | |
|---|---|---|---|
| 27495 | 4/1931 | Australia | 219/315 |
| 108453 | 8/1939 | Australia | 219/314 |
| 53585 | 9/1937 | Denmark | 219/312 |
| 609199 | 2/1935 | Fed. Rep. of Germany | 219/314 |
| 1057312 | 5/1959 | Fed. Rep. of Germany | 219/314 |
| 521586 | 3/1955 | Italy | 219/314 |
| 365242 | 1/1932 | United Kingdom | 219/314 |
| 365670 | 1/1932 | United Kingdom | 219/314 |

*Primary Examiner*—A. Bartis

*Attorney, Agent, or Firm*—Schwartz, Jeffery, Schwaab, Mack, Blumenthal & Koch

[57] ABSTRACT

A two-stage electric water heater adapted to store water at a comparatively low temperature and to heat the outflowing stored water to a desired higher temperature includes a storage vessel provided with an elongated thermostatically controlled electric resistance heating element positioned in the vessel and surrounded in space-apart relationship by an elongated imperforate metal tube having a closed outer end attached to a wall of the vessel and an open inner end at a higher level in the vessel and terminating short of the top of the vessel. A heated water outlet extends from the outer end of the tube to the outside of the vessel. An elongated tubular thermally insulating body concentrically surrounds a major part of the length of the tube and is spaced therefrom to form a convective water flow passage communicating with the interior of the vessel proximate the inner and outer ends of the tube. During non-consumption water flows upward through the water flow passage and is heated to a medium temperature by heat transfer from the metal tube for storage in the vessel. During consumption the stored water flows from the vessel into the tube through the open end thereof and is heated to a high temperature by direct contact with the electric heater prior to discharge through the outlet for consumption.

8 Claims, 6 Drawing Figures

TWO-STAGE ELECTRIC WATER HEATER

Figure 1:
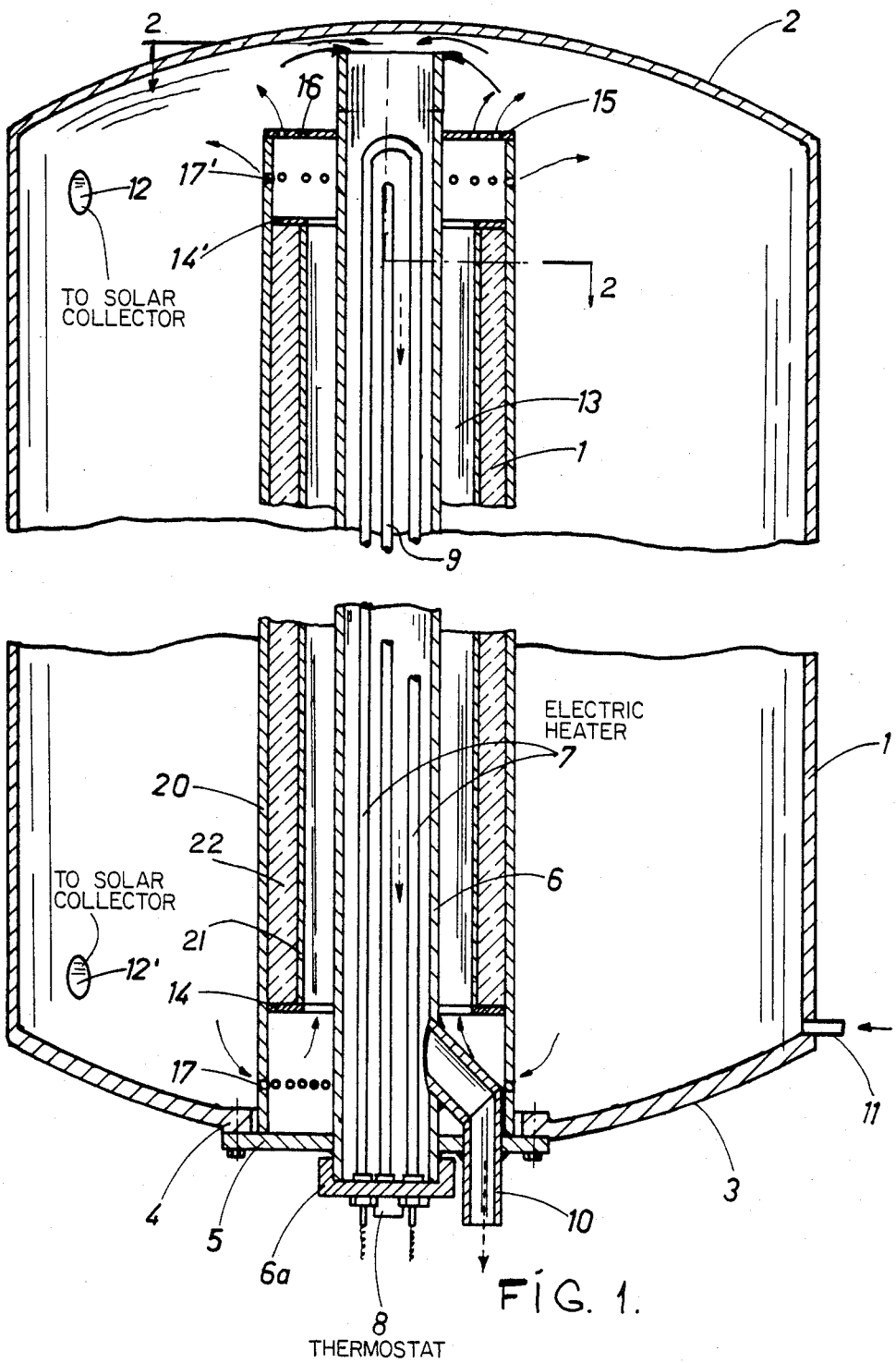

The invention relates to an electric water heater adapted to store water at a comparatively low temperature and to heat the outflowing water to the desired high temperature. It relates both to a domestic water heater and to a storage vessel forming part of a solar radiation heating plant.

The known domestic storage heaters comprise a vessel of sufficient volume (up to 120 liters) which is heat-insulated on its outside and is provided with an immersed electric heating element and a thermostatic switch. The thermostat is set to the required high temperature and interrupts the electric current to the heating element when the design temperature has been reached, switching it on again as soon as the water temperature drops. This arrangement holds good both for solar heaters, wherein the heating element is actuated only when the sun is covered by cloud for prolonged periods, and for pure electric heaters mounted inside the house, usually in the vicinity of the bathroom.

It should be noted that the water in the vessel is generally heated to a much higher temperature than that required for a bath or a shower, and that the hot water has to be mixed with cold water while running into the bath tub, as otherwise the vessel would be required to hold a much larger water volume, in order to enable a family of many persons to fill one bath tub after the other, or to take many consecutive showers.

Keeping the water permanently at a high temperature is wasteful owing to heat losses to the outside which are high, even with good insulation, moreover as usually the flange carrying the electric and water connections is not insulated and plays an important part in conducting valuable calories into the surrounding air.

Another point against keeping the water at a high temperature is that the vessel walls and the electric components are exposed to quicker wear and tear, which reduces the life expectancy of the water heater.

In order to counteract the thermal losses, it has long been proposed to heat the water in the vessel initially to a relatively low temperature, to hold it at this point during most of the day and the night and to heat it to the required high temperature needed for bath, shower or dishwashing only when water is drawn out of the vessel. The simplest way, as employed by many householders, is to switch on the heater some time before hot water is actually required. This procedure is rather inconvenient, especially in the early morning, and it often happens that the switch is not turned off afterwards.

To overcome this inconvenience, many different apparatus have been invented, nearly all of them based on the principle that water is first heated to medium temperature by switching on the heating element a given time before hot water is required, and to heat it to a high temperature by passing it through a so-called throughflow heater. A number of these devices are designed so as to cause the water to circulate very slowly inside the vessel, whereby a layer of warm water accumulates at the top of the vessel, and gradually diminishes in temperature towards the bottom. The warm water near the top is drawn out first when a tap is opened, and it passes through a duct containing a heating element which increases its temperature to the required degree. These devices are mostly characterized by the fact that the water circulates in the vessel in one sense of direction during the preheating process, and in reversed direction during final heating while water is extracted and fresh water enters the vessel. The reversed circulation is obtained by means of a jet pump actuated by the incoming water, which causes the cold water to accumulate near the bottom of the vessel.

In my Israeli Patent Specification No. 53083 I have disclosed an auxiliary electric heating unit positioned in a storage vessel of a solar heater, which operates during periods of insufficient solar radiation.

It consists in a heat-insulated tube extending from the bottom of the vessel to a small distance from its top and provided with an outflow opening near the bottom. An electric resistance heater and a thermostat of commensurate length are positioned in this tube causing water passing from the top of the vessel through the tube to the outflow, to be heated by contact with the heating element. As long as no water is consumed, the bulk of the water heats up very slowly, since the heating element is insulated from the surrounding water by the insulated tube, and since circulation along the tube interior is slow. This slow circulation causes a layer of warmer water to accumulate near the top of the vessel which does not readily mix with the colder water underneath, whereby—after a certain time—no more circulation will take place inside the insulated tube, and the thermostat will terminate the heating action. Eventually the warm and cold water mix somewhat, thus lowering the temperature near the top and, thereby, causing the thermostat to re-energize the heating element; this is, however, a slow process and the bulk of the water will remain at an intermediate temperature for a long period.

The heating unit of the present invention is an improvement over the aforementioned device and is adapted to be positioned in a storage vessel of a solar heating installation or in an all-electric domestic water heater. It consists generally of a heater tube of a heat-conductive material, such as steel, provided at its lower end with a water outlet penetrating the wall of the vessel, and extending across the vessel, having its upper open end positioned close to the top surface of the vessel; a resistance-type heating element and the feeler of a thermostatic switch are inserted into the heater tube from the outside of the vessel and extend parallel to the tube axis. A tubular heat-insulating body surrounds the heater tube concentrically and distanced therefrom, so as to create a cylinder-shaped water passage therebetween. The water passage communicates, proximate the lower end of the heater tube, with the vessel interior by at least one opening which serves as water inlet into the passage, and it communicates, proximate the upper end of the heating element, with the vessel interior by means of at least one opening which serves as water outlet from the passage, the outlet being at a higher level than the inlet.

The heat-insulating body consists preferably of an inner and an outer tube of plastics or another material in concentric alignment, the space between the tubes being filled with insulating material. The outer tube is longer than the inner tube, the insulation extending only as far as the inner tube and being enclosed by two end plates in contact with the ends of the inner tube and the interior of the outer tube. The outer tube is generally closed at its upper end by an end plate which serves to hold the insulating body in correct position on the metallic tube, and the portions projecting beyond the inner tube are perforated by openings which permit water to enter and to leave the passage.

In a vessel having a vertical axis the heating unit is preferably vertically and concentrically positioned in the vessel with the heater tube extending from the bottom to near the top of the vessel.

In a vessel having a horizontal or slightly inclined axis the heating unit is positioned at an inclination towards the horizontal; the upper, open end of the heater tube extends to a point close to the top surface of the vessel. The opening at the upper end of the insulating body is at a higher level than the opening at the lower end, in order to create a water flow in upwards direction through the passage due to heating of the water.

In another embodiment of the invention the heating unit is concentrically positioned in a horizontal vessel which, however, has its axis slightly inclined, resulting in a similar inclination of the heating unit, thus raising the inner end of the unit slightly above the level of its outer end. An elongation in the form of a pipe bend is attached to the upper end of the heater tube, this elongation extending up to the top of the vessel, leaving only a small gap therebetween through which warm is drawn through the tube.

The heating unit is generally mounted on a strong baseplate of such size that it can be inserted into a vessel of standard dimensions and the baseplate can be bolted to the existing flange of the vessel, which permits the conversion of existing vessels to a dual-purpose heater.

Water is heated in two stages in a heater of the invention: as soon as the heating element is energised, the water in the heater tube is brought to a high temperature and the heat is conducted through the tube walls to the water in the water passage. The warm water rises in the passage and enters the top of the vessel through the opening in the heat-insulating body, thereby drawing cold water into the passage from the lower portion of the vessel and creating a slow circulation. The bulk of the water is not directly heated by the heater tube, since the insulating body prevents heat from being transferred therethrough. Gradually a warm water layer builds up in the upper portion of the vessel, while the water in the lower portion stays at a much lower temperature. The warm water at the top causes the water in the heater tube to remain stagnant, thereby rising to a temperature which causes the thermostat to switch off the heating element, and to stay in the "off" position until the water has cooled down by radiation and intermixing to a degree which energizes the element anew. In any case, the bulk of the water in the vessel remains at a relatively low temperature, thus saving energy by non-radiation of heat into the surrounding atmosphere. In all cases where hot water is not used continuously, but only during certain periods of the day, the water heater may remain switched off most of the time, to be switched on by the person a short time before he or she wishes to use hot water. The time required for pre-heating of water is learned by experience.

As soon as water is drawn out of the vessel by opening of a tap, water from the top of the vessel passes through the heater tube to the outlet, and the thermostat energizes the heating element at once, since the water in the vessel is cooler than the design temperature. The water is hereby additionally heated in the tube and passes through the outlet at the required temperature. The bulk of the water in the vessel is likewise heated by circulation through the water passage, whereby warm water rises to the top, while cold water is added through the water inlet which is, as usual in all water heaters, near the bottom of the vessel. As soon as no more water is required the heating process continuous through the water passage alone.

The heating process is similar for a vertical vessel provided with a vertical heating unit and a vessel provided with an inclined unit. However, in the inclined heater unit the circulation through the water passage is usually slower which causes almost no disturbance which will result in a much sharper distinction between the warm water layer at the top and the cooler water in the lower portion of the vessel. In all vessels warm water is drawn from the very top of the vessel resulting in sufficiently hot water at the tap.

Vessels with an inclined heater unit are more advantageous owing to the slow circulation which leaves warm water at the top and cooler water at the bottom of the vessel without their intermixing. This may, in many cases, permit leaving the heating element energized all day long, without raising the median water temperature in the vessel to the maximum, thus saving energy.

Figure 2:
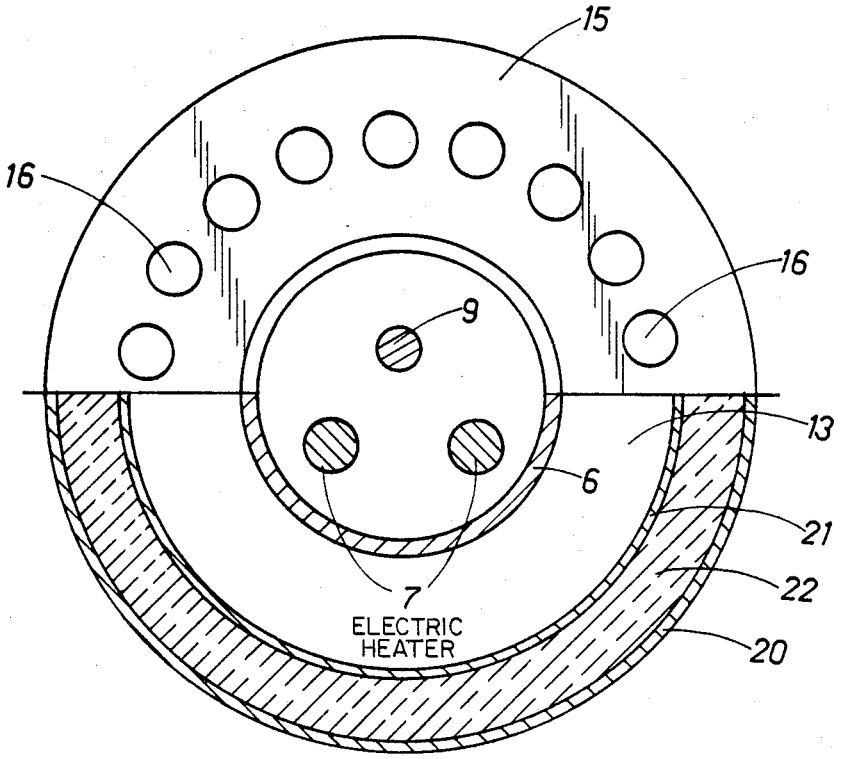
Figure 3:
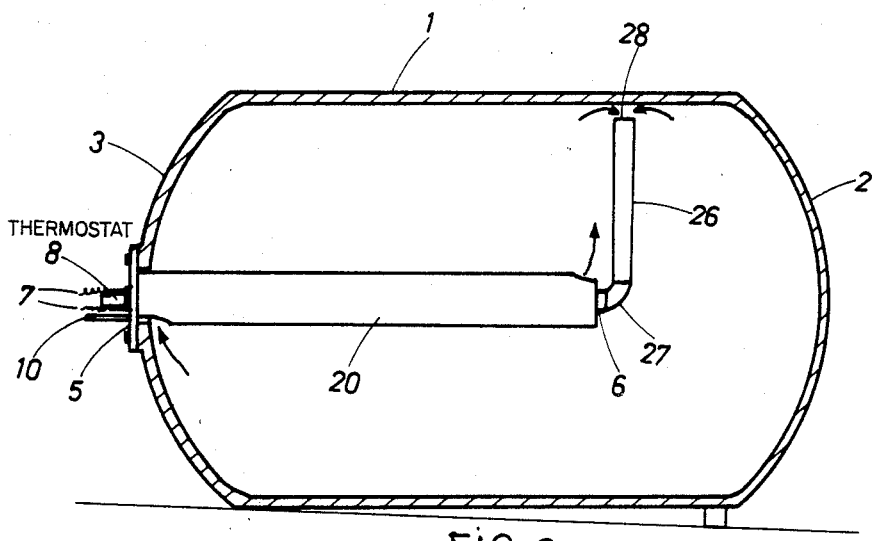
Figure 4:
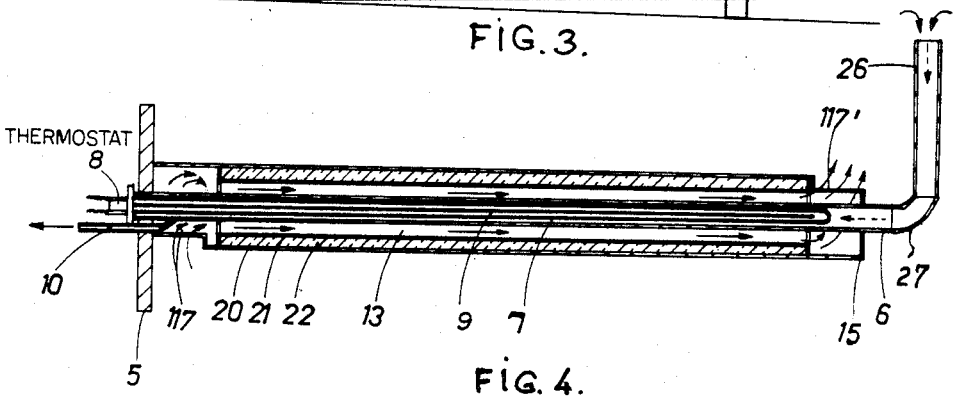
Figure 5:
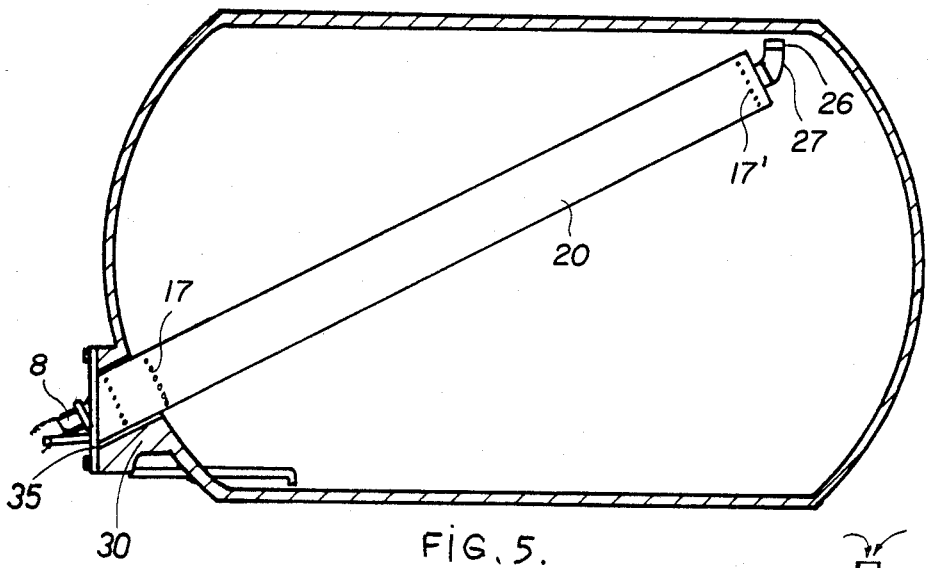
Figure 6:
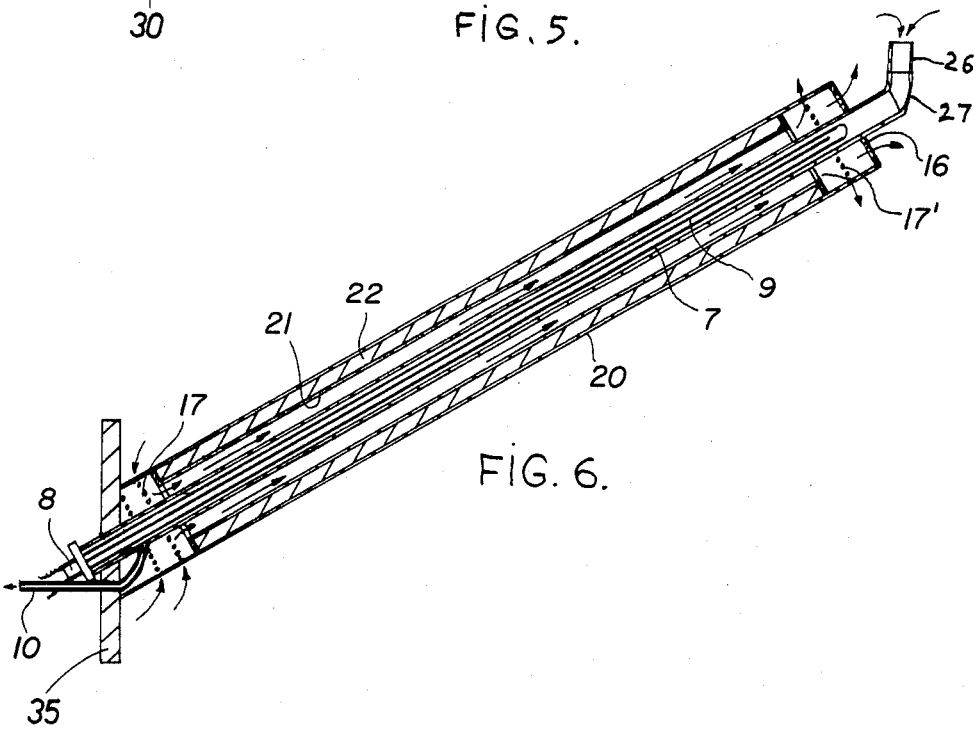

In the accompanying drawings which illustrate, by way of example only, several embodiments of the invention, FIG. 1 is a vertical section through a vertically positioned vessel comprising a concentric heating unit, FIG. 2 is a section along section line 2—2 of FIG. 1, FIG. 3 is a section through a horizontal vessel comprising a concentric heating unit, FIG. 4 is a section through the heating unit of FIG. 3 on an enlarged scale, FIG. 5 is a section through a horizontal vessel comprising an inclined heating unit, and FIG. 6 is a section through the heating unit of FIG. 5 on an enlarged scale.

Referring now to FIGS. 1 and 2 of the drawings, a storage vessel comprises a cylindrical shell 1, a dished top 2 and a dished bottom 3, the latter being perforated by a large opening surrounded by a horizontal flange 4. The heating unit of the invention is mounted on a strong baseplate 5 and comprises the following components: a vertical tube 6 of a heat-conductive material such as steel, penetrating through the base plate 5 and tightly connected thereby by welding. This heater tube 6 projects downwards out of the baseplate and extends at its top to a short distance from the top of the vessel, leaving a gap for the inflow of water into the tube. The lower end of the tube is tightly closed by a cap *6a* which holds the two ends of a U-shaped tubular heating element 7 and a thermostatic switch 8 the feeler 9 of which runs parallel to the heating element, the heating element being slightly shorter than the tube 6.

A water outlet pipe 10 is connected to the side of the tube 6 close to the plate 5 and penetrates through an opening in this plate to the outside, being firmly and tightly connected to the plate by welding. The vessel is provided with a fresh water inlet 11 and with two ports 12 and 12' which may serve as connections to a solar collector, in case the vessel is used for this purpose. The tube 6 is completely surrounded by a tubular heat-insulating body which has an inner diameter larger than the outer diameter of tube 6, thus forming a water passage of annular cross section 13 extending between the tube 6 and the insulating body.

The heat-insulating body may be in the form of a solid plastic tube of sufficient thickness or, as illustrated in the present drawing, it may consist of an outer tube 20, an inner tube 21 and an insulating material 22 inserted into the space between the two tubes, the latter being advantageously made of a plastic material of high heat insulation. The outer tube 20 is slightly shorter than the heater tube 6, its top being about level with the top of the heating element 7, while the inner tube 21 and the insulation 22 are shorter than the outer tube which is thus projecting beyond the inner tube, both at the top and at the bottom. The insulation 22 is enclosed in the space defined by the inner tube, by means of two annular end plates 14 and 14' which are connected to the two tubes by glueing or by other connecting means used in the production of plastic bodies. The top of the outer tube is closed by a third annular endplate 15 which also serves to hold the insulating body in concentric alignment with the tube 6, and which is perforated by holes 16. The end portions of the outer tube projecting beyond the insulation are likewise perforated by a plurality of holes 17 and 17' which serve as water inlets and outlets respectively.

The water heater illustrated in FIGS. 3 and 4 comprises identical components as that of FIGS. 1 and 2, i.e. a cylindrical storage vessel provided with dished ends and a heating unit inserted into the vessel through a central opening in one of its dished ends and bolted to a flange therein. For comparison of the two embodiments identical reference numbers are being used to indicate identical or similar components. The main difference lies in the fact that in the present embodiment both vessel and heating unit are in lying position, with their axes inclined to the horizontal by a small angle, whereby the inner end of the heating unit is at a somewhat higher level than its outer end, close to the base plate. With the aim to promote upwards movement of the heated water in the water passage 13, the small perforations 17 and 17' in the outer tube 20 of the insulating body, as appearing in the aforedescribed embodiment, are replaced by a large opening 117 in the lower portion of the tube 20 adjacent the base plate 5, and by a similar opening 117' in the top portion of the tube 20 at the inside end of the heater unit.

The holes 16 appearing in FIGS. 1 and 2 as perforating the endplate 15 are likewise omitted in the present embodiment, the water entering the passage 13 though the opening 117 and leaving it through the opening 117'. A substantially vertical pipe 26 is attached to the inner end of the heater pipe 6 by means of a bend 27 and extends to a small distance from the top of the vessel; warm water enters this pipe through the thus-created gap 28, is heated during its passage through the heater tube and leaves the water heater through the outlet pipe 10. The function of this embodiment is substnatially identical with that of the aforegoing embodiment.

The water heater illustrated in FIGS. 5 and 6 differs from the aforegoing embodiments in that the heater unit is obliquely positioned in a horizontal storage vessel. For this purpose a collar 30 is provided in one of the dished ends of the vessel which contains an inclined bore adapted to receive the heating unit. The latter is cut off at an angle, and a base plate 35 is fastened thereto, whereby the surface of the baseplate lies in a vertical plane. The heating unit is substantially identical with that illustrated in FIGS. 1 and 2, comprising a plurality of small openings in the outer tube and the endplate of the insulating body. The flow direction through the water passage of the heater unit is shown by means of arrows.

The operation of the heating unit in the storage vessel will now be described with reference to the embodiment illustrated in FIGS. 1 and 2. Assuming that the vessel is initially filled with cold water and that the heating element is connected to the current supply, then the water in the heater tube will be heated and will cause a certain circulation in this tube, heated water rising to the top. Since the tube is heat-conductive, its walls will transfer the heat to the water in the passage 13 causing it to rise and to escape to the top of the vessel through the perforations 16 and 17', while drawing cold water into the passage from the vessel bottom through perforations 17. Slowly warm water—which is lighter than cold water—will accumulate in the upper part of the vessel without noticeably intermixing with the cooler water in the bottom portion, because the circulation through the water passage is very slow.

As soon as the water at the top has reached a given temperature, its movement in the water passage will almost cease, and the water in the heater tube will reach a temperature sufficiently high to monitor the thermostat to the effect of de-energizing the heating element. The element will reamin switched off, until the water at the top has cooled down by radiation or partial intermixing with the lower water layers, and will then be energized by the thermostat, until the former state has been reestablished.

As soon as water is drawn out of the vessel through the outlet 10, fresh water enters through the inlet 11. Warm water from the top passes through the heater tube to the outlet, as shown by dashed line arrows and since the water temperature is below the design temperature, the thermostat will immediately energize the heating element. The water passing along the heating element is heated and leaves the outlet at the desired high temperature. While the heating element is in action a certain percentage of its output passes through the walls of the heater tube to the water in the passage, creating a forced circulation of warmer water to the top, although the action is less vehement than in the case the water inside the heater tube is practically stagnant at a high temperatures. The heater is advantageously switched on manually a given time before hot water is required, but even in case that it is switched on continuously, the median temperture in the vessel will be relatively low, thus eliminating heat losses, especially those through the not-insulated base plate.

The embodiment of FIGS. 3 and 4 has proved itself especially useful, in that it maintains a sharp separation between warm and cool water, owing to the relatively slow circulation through the almost horizontal water passage. In this embodiment it is even not necessary to switch off the heating element, as the water temperature will remain in the vessel for a long period without rising considerably, thus saving energy.

The shape of the vessel and the heater unit may be altered to suit various purposes and locations, and this applies especially to the insulating body of the heater unit which may be manufactured as one solid, hollow body from a plastic, or as a compact body from a foamed plastic, inserted of being assembled from several components.

I claim:

1. A dual-purpose water heater consisting of a storage vessel and a heating unit inserted therein, said heating unit comprising:

an elongated, imperforate heater tube of a heat-conductive material within said storage vessel and having an outer, closed end attached to the wall of said storage vessel, and an inner, open end terminating short off the top of said storage vessel, said heater tube being provided with a water outlet pipe proximate its outer end, said pipe extending to the outside of the vessel;

an elongated resistance-type immersion heating element positioned in said heater tube parallel to the tube axis and extending from its outer end to near the inner end of said tube, said heating element being provided with electric terminals on the outside of said vessel;

a thermostatic switch having its feeler inserted into said heater tube from the outside of said vessel, for energizing said heating element in accordance with the water temperature within said tube;

an elongaged tubular heat-insulating body in said vessel surrounding a major portion of the length of said heater tube concentrically and distanced therefrom so as to create a water passage of annular cross section between said insulating body and said heater tube, said insulating body being provided with at least one first opening communicating the interior of said vessel with said water passage proximate the outer end of said heater tube and with at least one second opening communicating the interior of said vessel with said water passage proximate the inner end of said heating element, said at least one second opening being positioned at a higher level than said at least one first opening for establishing a convective flow of water through said water passage from said first to said second opening.

2. The water heater of claim 1, wherein said heater tube enclosing said heating element and said feeler of said thermostatic switch, and said heat-insulating body are mounted on and extend into the storage vessel from a circular base plate, said base plate being sealingly connected to a flange surrounding an opening in said storage vessel.

3. The water heater of claim 1, wherein said heat-insulating body consists of an outer tube and an inner tube in concentric alignment and of a heat-insulating material filling the space between said inner and said outer tube, said outer tube being longer than said inner tube so as to extend beyond said inner tube at both ends.

4. The water heater of claim 3, wherein the outer tube of said heat insulating body is attached to the inner end of said heater tube by an annular endplate.

5. The water heater of claim 1, wherein said storage vessel consists of a cylindrical shell closed at its ends by two dished end covers.

6. The water heater of claim 5, wherein said heating unit is mounted concentrically said storage vessel, the axes of said vessel and of said heating unit being substantially vertical.

7. The water heater of claim 5, wherein said storage vessel is positioned with its axis substantially horizontal, and said heating unit is positioned with its axis inclined in respect of the axis of said vessel and extending from the lower portion of one of said end covers to a point close to the top surface of said cylindrical shell.

8. The water heater of claim 5, wherein said heating unit is concentrically positioned within said storage vessel, said storage vessel and said heating unit having their common axis slightly inclined towards the horizontal in such a manner that the outer end of said heating unit is at a lower level than its inner end, said heater tube being elongated in vertical direction by means of a bend and a pipe sealingly connected to the open inner end of said heater tube, and so positioned that the open end of said tube s close to the top of said storage vessel.

* * * * *